US006109199A

United States Patent [19]

Wallach et al.

[11] Patent Number: 6,109,199

[45] Date of Patent: Aug. 29, 2000

[54] CAPTURE AND ALIGNMENT MECHANISM FOR USE ON BOARD AN OCEAN GOING VESSEL

[75] Inventors: Adam Wallach, Oxnard, Calif.; Erick Robert Ratzer, Sandia Park, N. Mex.

[73] Assignee: The United States of America as represented by the Secretary of the Navy, Washington, D.C.

[21] Appl. No.: 09/379,681

[22] Filed: Aug. 24, 1999

[51] Int. Cl.[7] ..... B63B 35/40

[52] U.S. Cl. ..... 114/259; 114/254; 294/82.32; 414/137.7

[58] Field of Search ..... 114/253, 254, 114/258, 259; 414/137.7; 294/82.32, 82.35

[56] References Cited

U.S. PATENT DOCUMENTS

| | | | |
|---|---|---|---|
| 4,130,313 | 12/1978 | Clifford | 294/82.32 |
| 4,662,300 | 5/1987 | McCallum et al. | 114/259 |
| 5,688,012 | 11/1997 | Siesjo et al. | 294/82.32 |

*Primary Examiner*—Sherman Basinger

*Attorney, Agent, or Firm*—David Kalmbaugh

[57] ABSTRACT

A capture and alignment mechanism which locks a deployable body to a sheave assembly. The sheave assembly is connected to a carriage which rides on a boom positioned above the deck of a ship and extends over the ship's stern. The mechanism includes a capture body having a conical shaped inner surface and a pair of capture pins positioned 180 degrees apart near the bottom of the capture body. A cable is terminated by a cable termination assembly which couples the deployable body to one end of the cable, while the other end of the cable is wrapped around a winch. The termination assembly includes a termination cone having an outer surface which aligns with the conical shaped inner surface of the capture body when the deployable body is hoisted upward to the capture and alignment mechanism. The capture pins are moved to an open position by a pneumatic cylinder allowing the termination cone to align with the inner surface of the capture body. When alignment of the termination cone and capture body occurs, air pressure is turned off which results in the capture pins returning to a closed position. The deployable body is lowered and its weight is suspended by the capture pins on a wave-like surface on the bottom of the termination assembly, allowing the deployable body to rotatably center itself.

12 Claims, 9 Drawing Sheets

CAPTURE AND ALIGNMENT MECHANISM FOR USE ON BOARD AN OCEAN GOING VESSEL

BACKGROUND OF THE INVENTION

1. Field of the Invention

The present invention relates generally to handling systems for use on board an ocean going vessel. More particularly, the present invention relates to a shipboard capture and alignment mechanism which is used in the recovery of a body deployed from the vessel.

2. Description of the Prior Art

There is currently a need to lift marine research equipment or other types of deployable bodies from the deck of a ship and then deploy the research equipment over the stern of the ship into the water to a given depth. The research equipment is suspended by a cable and can weigh as much as 8,000 lb. The deployment and recovery of the research equipment must be possible under varying sea conditions and while the ship is underway.

The deployable body, which is stored on the ship's deck, is raised from the deck and then relocated to a position where it is suspended over the stern of the ship. It is then deployed by paying out the cable which suspends the deployable body. The cable is fairleaded through a sheave with the sheave being driven in and out to locate the deployable body over the ship's stern or back over the ship's deck.

There is a requirement to suspend the deployable body/research equipment by a mechanism attached to the sheave while the sheave is being driven either in or out. Without such a mechanism, the cable suspending the deployable body would need to be hauled in or payed out by the winch in synchronization with the driving of the sheave in order to maintain the deployable body's vertical position above the deck which is needed to clear the ship's stern.

SUMMARY OF THE INVENTION

The capture and alignment mechanism of the present invention is a mechanical device which locks a deployable body to a sheave assembly so that the cable suspending the body can be slacked and the deployable body relocated to or from the desired position over the stern of a ship.

The sheave assembly is connected to a carriage which rides on a boom positioned above the deck of the ship and extends over the ship's stern. The capture and alignment mechanism hangs from the sheave assembly by a pair of shock absorbers. The capture and alignment mechanism includes a capture body having a conical shaped inner surface and a pair of capture pins positioned 180 degrees apart near the bottom of the capture body.

The cable is terminated by a cable termination assembly which couples the deployable body to one end of the cable, while the other end of the cable wrapped around a winch. The cable termination assembly includes a termination cone having an outer surface which aligns with the conical shaped inner surface of the capture body when the deployable body is hoisted upward to the capture and alignment mechanism. The capture pins are moved to an open position by an air activated pneumatic cylinder allowing the termination cone to enter the capture body and align with the conical shaped inner surface of the capture body. When alignment of the termination cone and capture body occurs, air pressure is turned off which results in the capture pins returning to a closed position. An extension spring holds the capture pins in the closed position which locks the deployable body to the sheave assembly.

The bottom surface of the cable termination assembly comprises a wave like surface which rests on the capture pins when the termination assembly is captured. This wave like surface allows the deployable body to rotate to a straight ahead position, while allowing the deployable body flexibility in rotation when external forces act on the deployable body. These external forces are attributable to the motion of the ship and to the impact of waves against the deployable body while the body is at water level.

DETAILED DESCRIPTION OF THE PREFERRED EMBODIMENT

Figure 1:
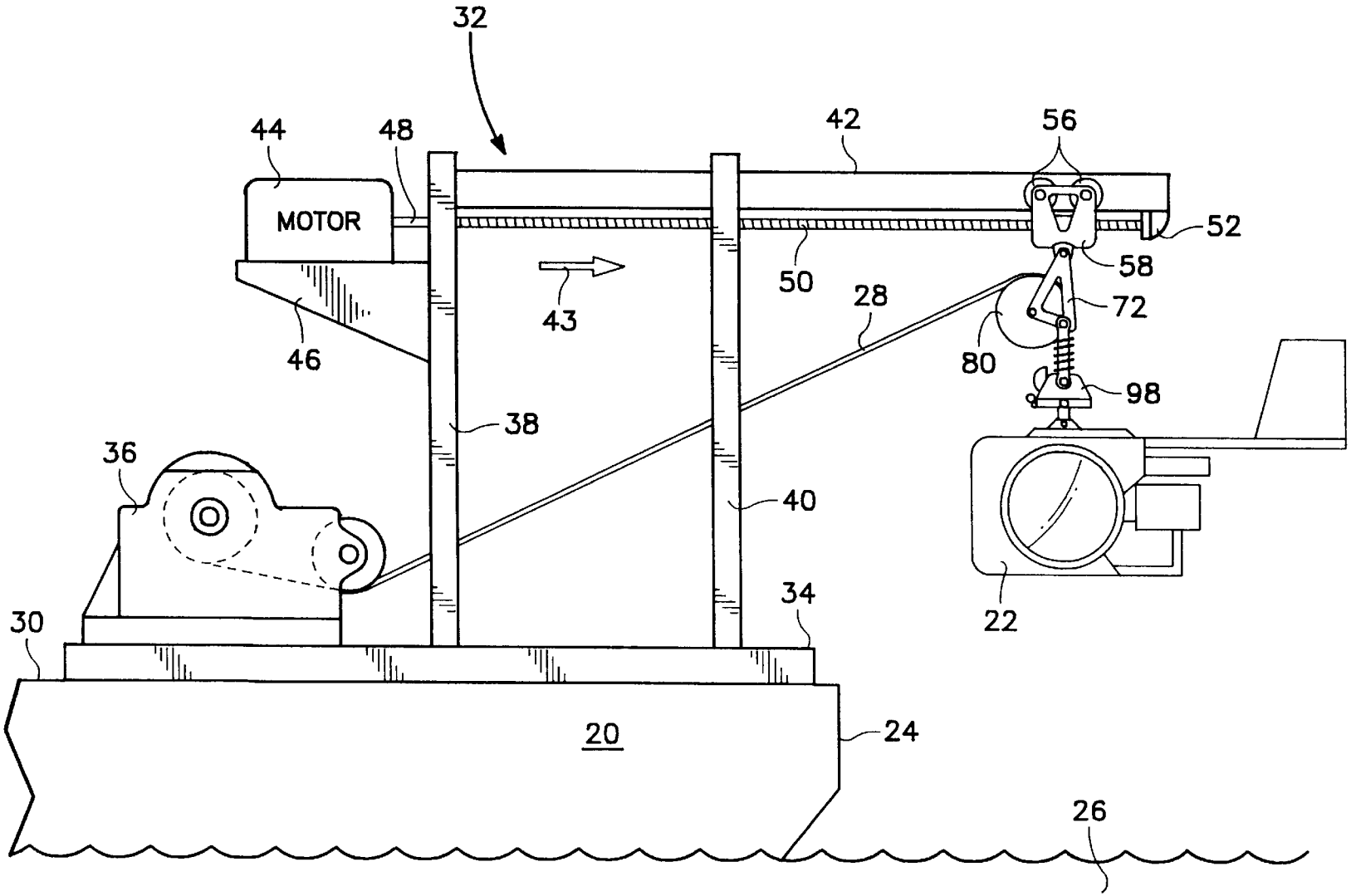
FIG. 1 illustrates a shipboard handling system which includes the capture and alignment mechanism of the present invention wherein a deployable body is extended over the stern of an ocean going vessel.
Figure 2:
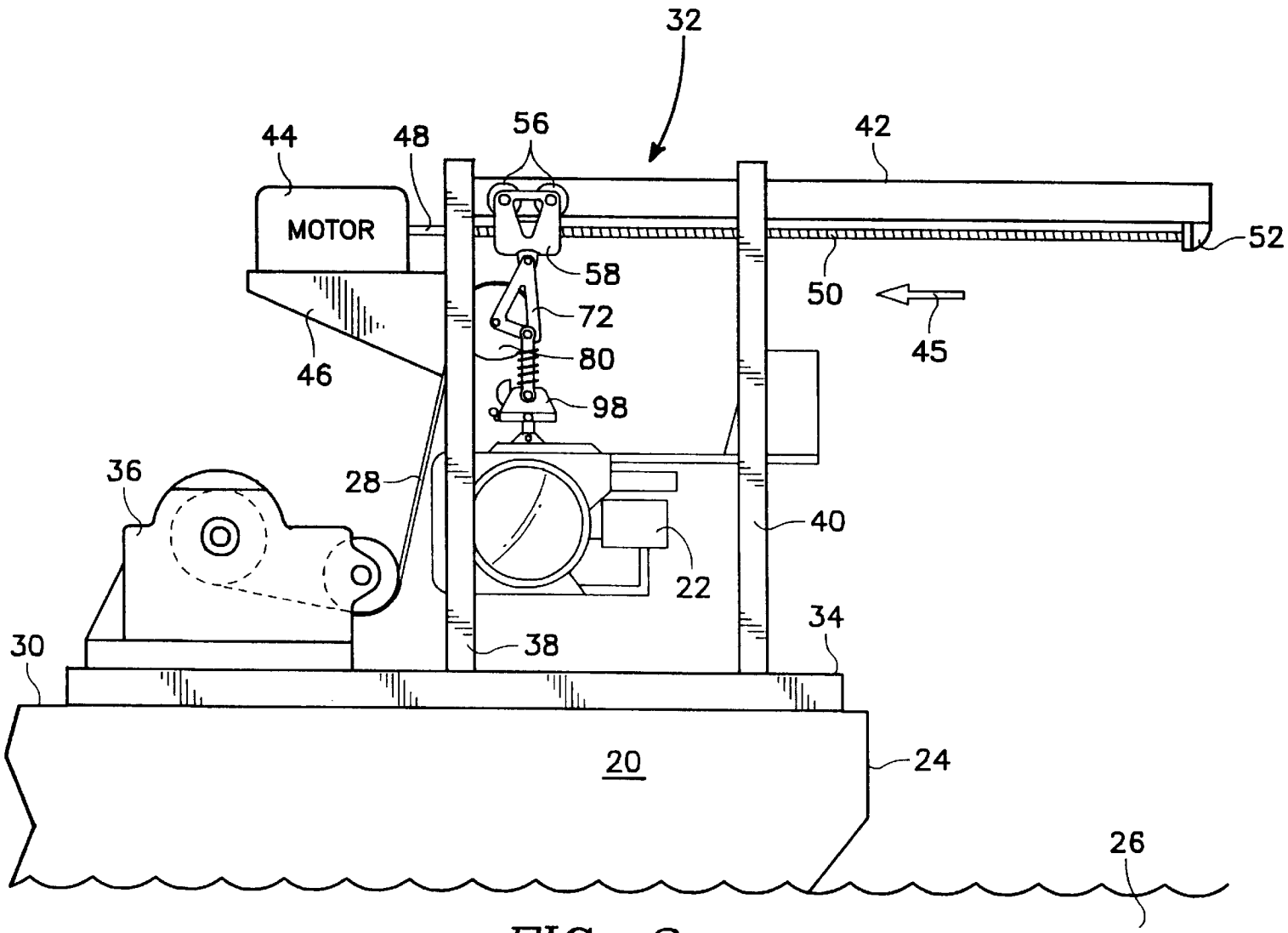
FIG. 2 illustrates the shipboard handling system of FIG. 1 wherein the deployable body is in a position to be lowered onto the ship for stowage.

Referring to FIGS. 1 and 2, there is shown an ocean going vessel 20 which allows for the deployment of a body 22 from its stern 24 into the water 26. Body 22, which is suspended from a cable 28, may be research equipment such as a towable sonar transducer and may weigh as much as 8,000 pounds.

Mounted on deck 30 of vessel 20 at its stern 24 is a shipboard handling system, designated generally by the reference numeral 32. Shipboard handling system 32 includes a mounting platform 34 affixed to the upper surface of deck 30; a winch 36 mounted on a forward portion of platform 34; a pair of tubular steel support members 38 and 40 which extend vertically upward from platform 34; and a boom 42 which is positioned horizontally at the top end of members 38 and 40 and is support by members 38 and 40.

A reversible direction hydraulic motor 44 is mounted on a motor support platform 46 located near the top end of support member 38. Attached to the shaft 48 of motor 44 is one end of a lead screw 50. Lead screw 50, which is parallel to and runs the length of boom 42, has its opposite end terminated by a lead screw support member 52 attached to boom 42.

Figure 4:
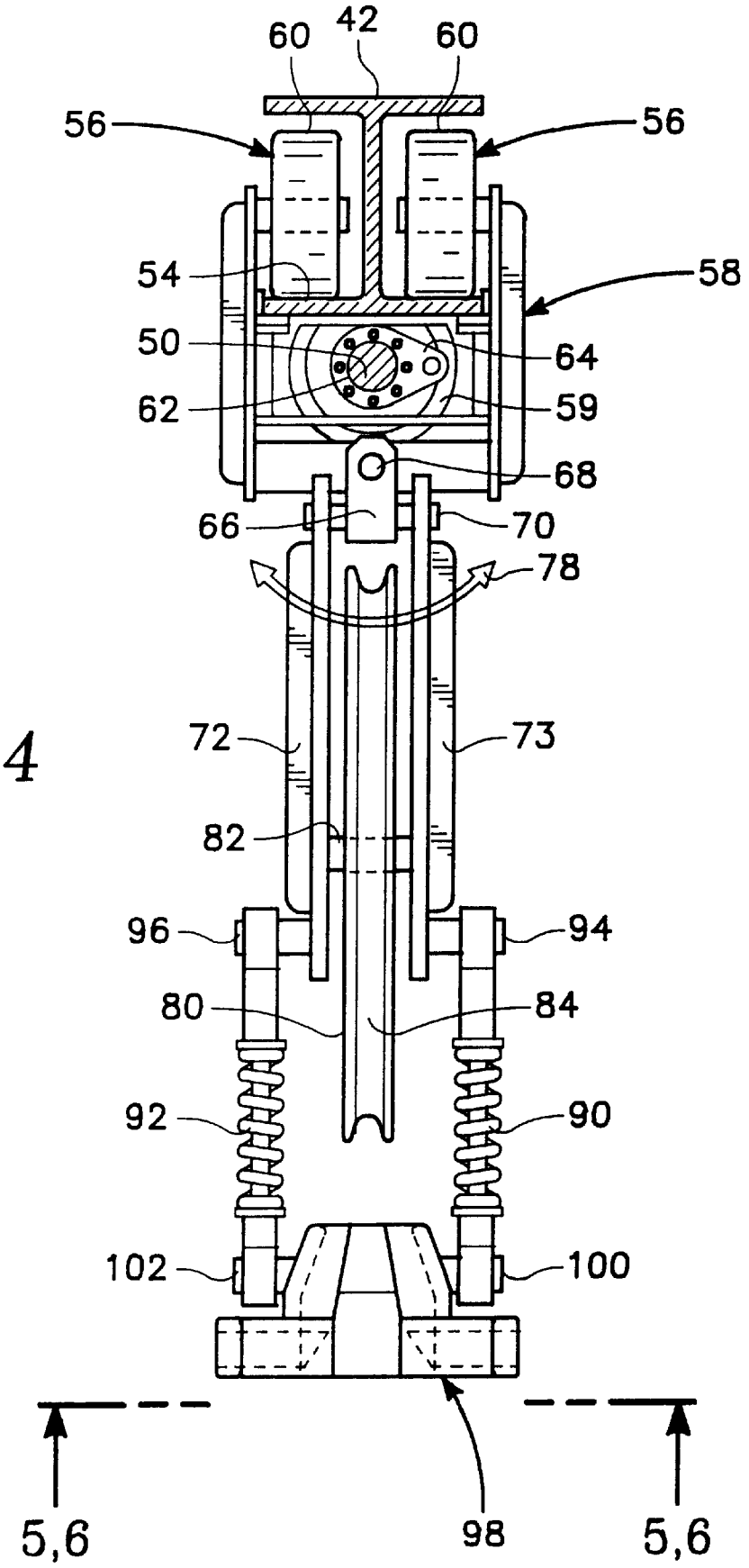
FIG. 4 is a front view taken along line 4—4 of FIG. 3 illustrating the carriage, sheave assembly and the capture and alignment mechanism of the handling system of FIG. 1.

Referring to FIGS. 1, 2 and 4, FIG. 4 illustrates the I beam structure of boom 42, which forms at its bottom portion a track 54. A carriage 58 has four wheels 56 which run along the track 54 of boom 42 in a rearward direction (indicated by arrow 43) to move carriage 58 away from the stern 24 of vessel 20 to the fully extended position illustrated in FIG. 1. The four wheels 56 of carriage 58 also run along track 54 in a forward direction (indicated by arrow 45) to move carriage 58 from the fully extended position of FIG. 1 to the stored position of FIG. 2. Each of the four wheels 56 of carriage 58 has a layer of urethane 60 on its outer surface which engages the track 54 of boom 42.

Referring to FIGS. 1, 2, 3 and 4, carriage 58 has a brass nut 59 which includes a threaded opening 62 through which lead screw 50 passes. The threads of lead screw 50 mate with the threads of opening 62. When reversible direction motor 44 is activated by the user of shipboard handling system 32 the shaft 48 of motor 44 rotates causing rotation of lead screw 50 which results in movement of carriage 58 in rearward direction 43 (FIG. 1) or forward direction 45 (FIG. 2).

Carriage 58 includes a torque arm 64 which secures brass nut 59 to carriage 58 and also prevents rotational movement of brass nut 59 to allow carriage 58 to move in the rearward direction 43 along boom 42 or the forward direction 45 along boom 42.

Figure 3:
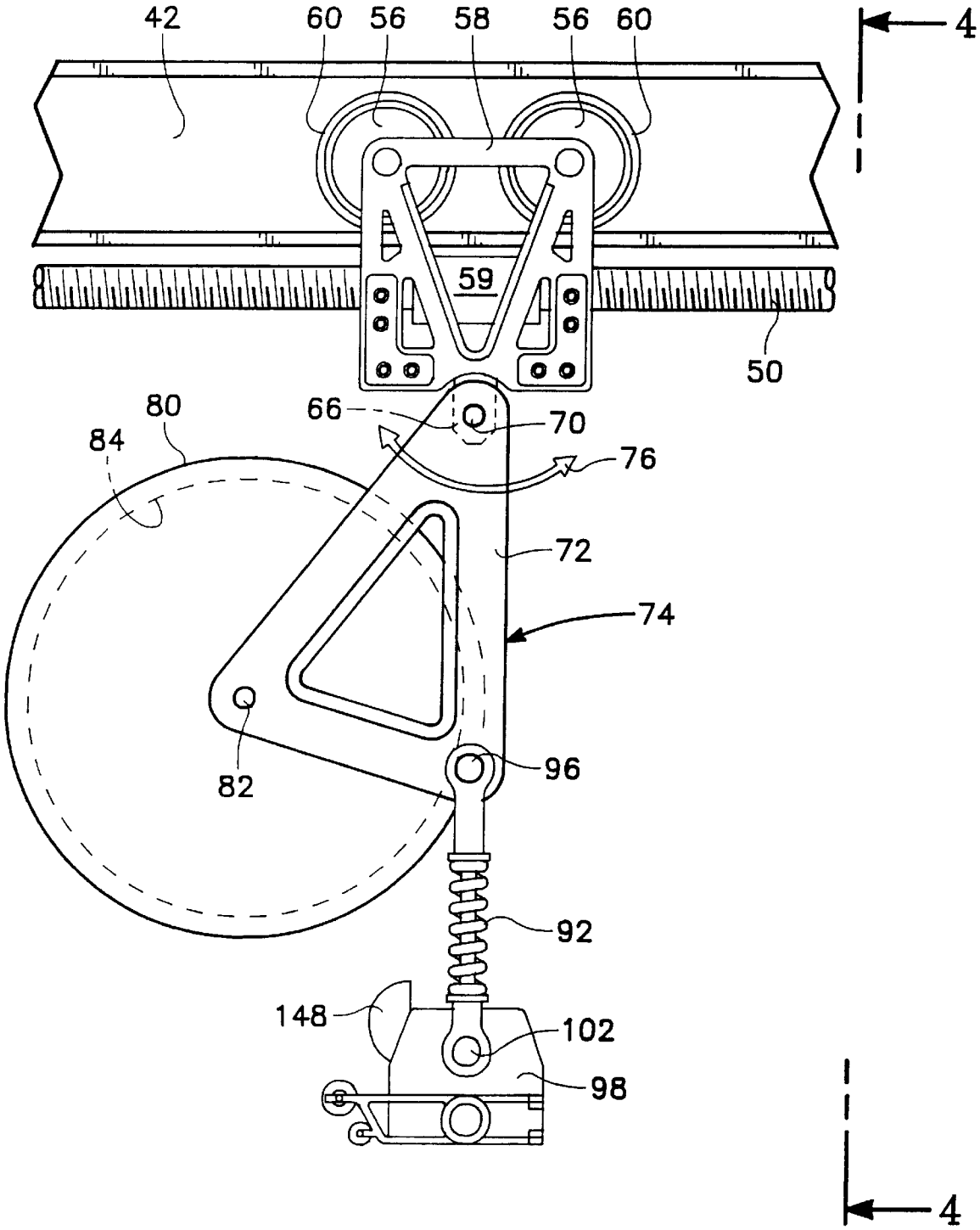
FIG. 3 is a side view illustrating the carriage, sheave assembly and the capture and alignment mechanism of the handling system of FIG. 1.

Positioned at the bottom of carriage 58 is a universal coupling 66 which is secured to carriage 58 by an axle pin 68. An axle pin 70 secures the triangular shaped cheek plates 72 and 73 of a sheave assembly 74 to carriage 58. As shown in FIG. 3, axle pin 70 allows for rotational movement of sheave assembly 74 in the manner indicated by arrow 76. Similarly, axle pin 68 allows for rotational movement of sheave assembly 74 in the manner indicated by arrow 78 (FIG. 4).

A sheave 80 is rotatably coupled to the triangular shaped cheek plates 72 and 73 of sheave assembly 74 by an axle pin 82. Sheave 80 includes a groove 84 which engages cable 28.

Figure 7:
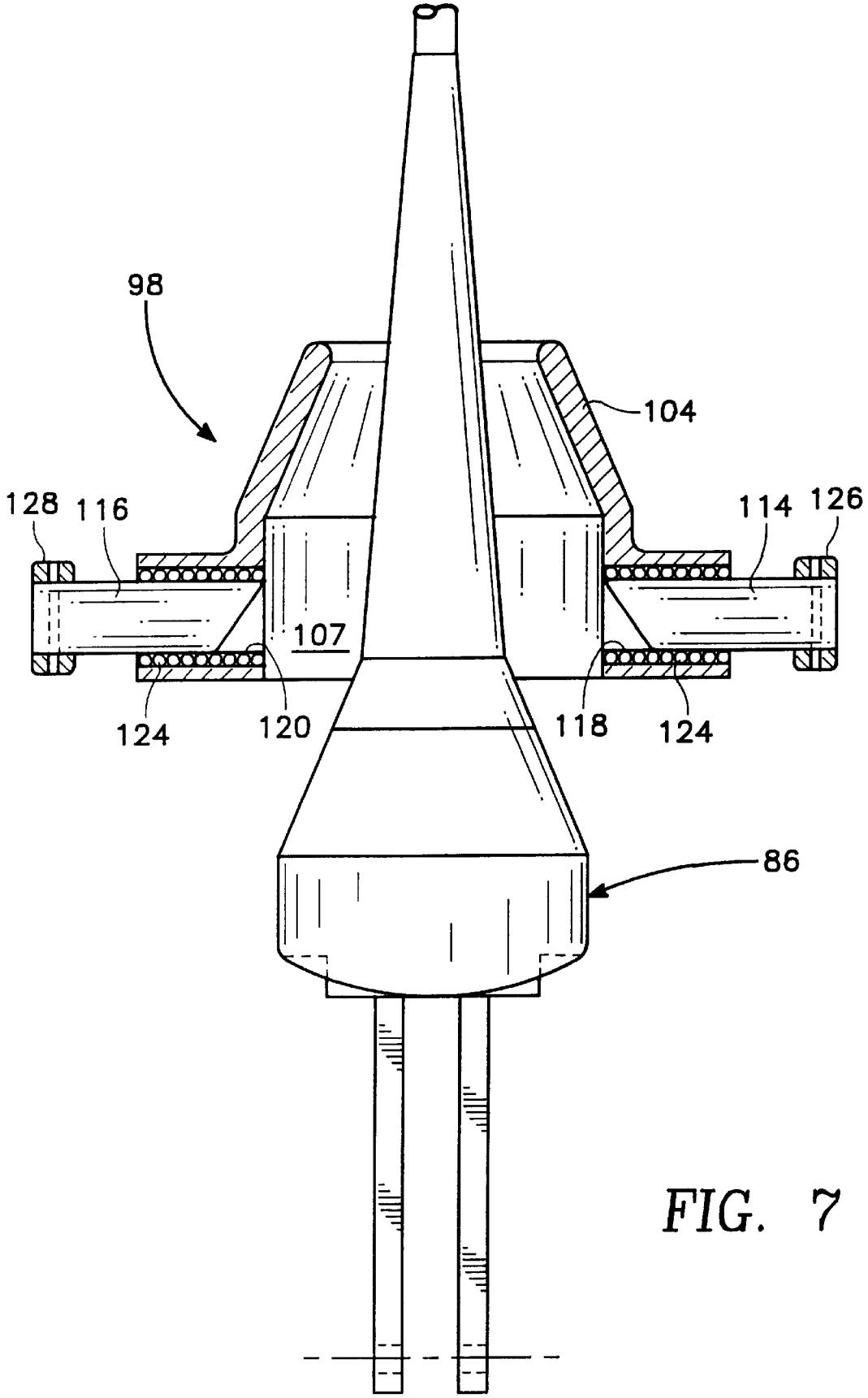
FIG. 7 is a front view in section illustrating the cable termination assembly prior to being locked to the capture and alignment mechanism of the handling system of FIG. 1.

Referring to FIGS. 1 and 7, winch 36 has one end of cable 28 wrapped around winch 36, while the opposite end of cable 28 terminates within the cable termination assembly 86 (FIG. 7). Cable 28 is secured within cable termination assembly 86 by means of hardened epoxy and includes a plurality of electrical conductors/wires (not illustrated) connected to sonar transducer 22. The electrical wires of cable 28 allow for the transfer of information (in the form of electrical signals) from sonar transducer 22 to processing equipment located on vessel 20.

Referring to FIGS. 1, 3 and 4, a pair of shock absorbers 90 and 92 are rotatably coupled to the bottom portion of triangular shaped cheek plates 72 and 73. An axle pin 96 is used to rotatably couple the top end of shock absorber 92 to cheek plate 72, while an axial pin 94 is used to rotatably couple the top end of shock absorber 90 to cheek plate 73. The bottom end of shock absorbers 90 and 92 are rotatably coupled to a capture and alignment mechanism 98. An axle pin 102 is used to rotatably couple the bottom end of shock absorber 92 to capture and alignment mechanism 98, while an axial pin 100 is used to rotatably couple the bottom end of shock absorber 90 to capture and alignment mechanism 98.

Shock absorbers 90 and 92 allow for a margin of error when the operator is vertically positioning body 22 from stern 24 of vessel 20. Shock absorbers 90 and 92 will absorb a substantial portion of the impact of body 22 when body 22 is driven into capture and alignment mechanism 98 using excessive force.

Pinning shock absorbers 90 and 92 at both ends in the manner shown in FIGS. 1 and 2, provides the following advantages: (1) capture and alignment mechanism 98 is allowed to swing with respect to sheave assembly 74; and (2) bending moments are eliminated in shock absorbers 90 and 92.

Figure 5:
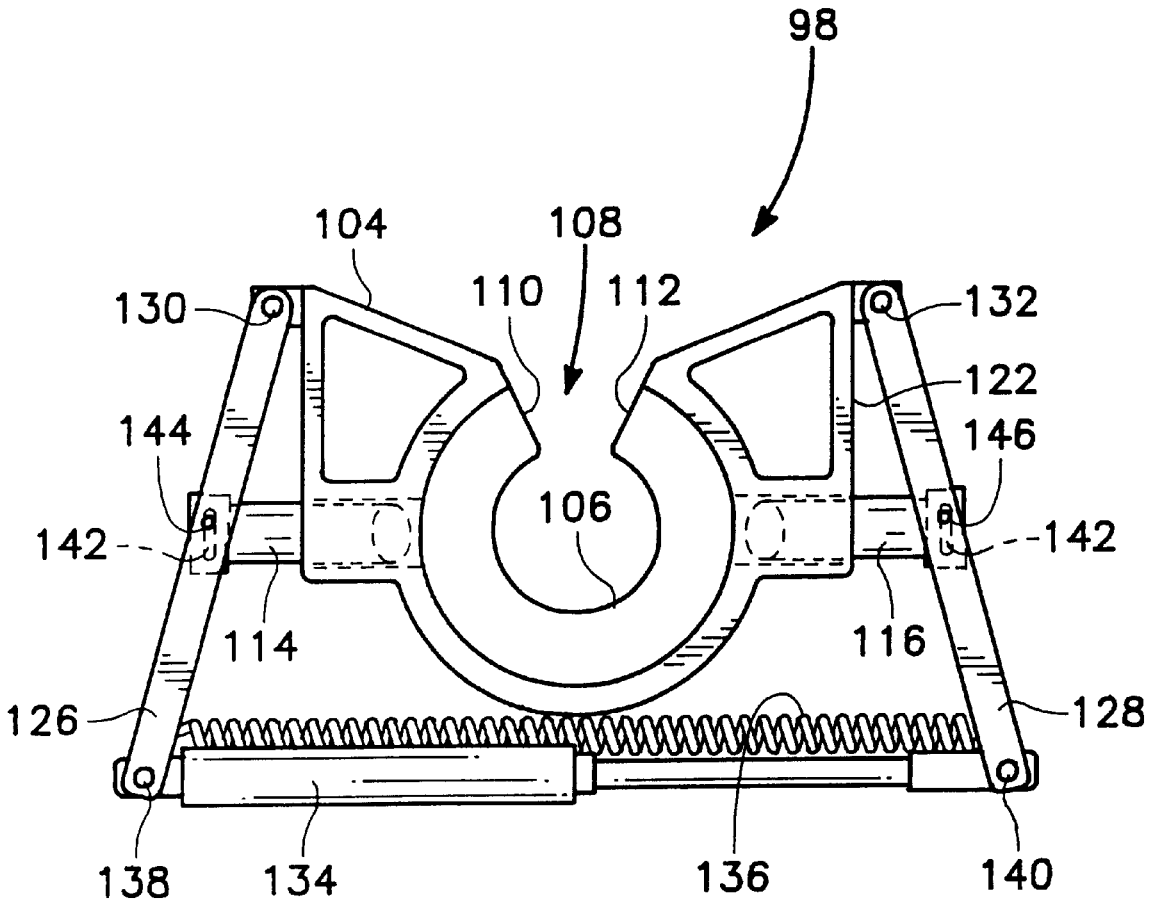
FIG. 5 is a bottom view taken along line 5—5 of FIG. 4 illustrating the capture and alignment mechanism of the handling system of FIG. 1 in an open position.
Figure 6:
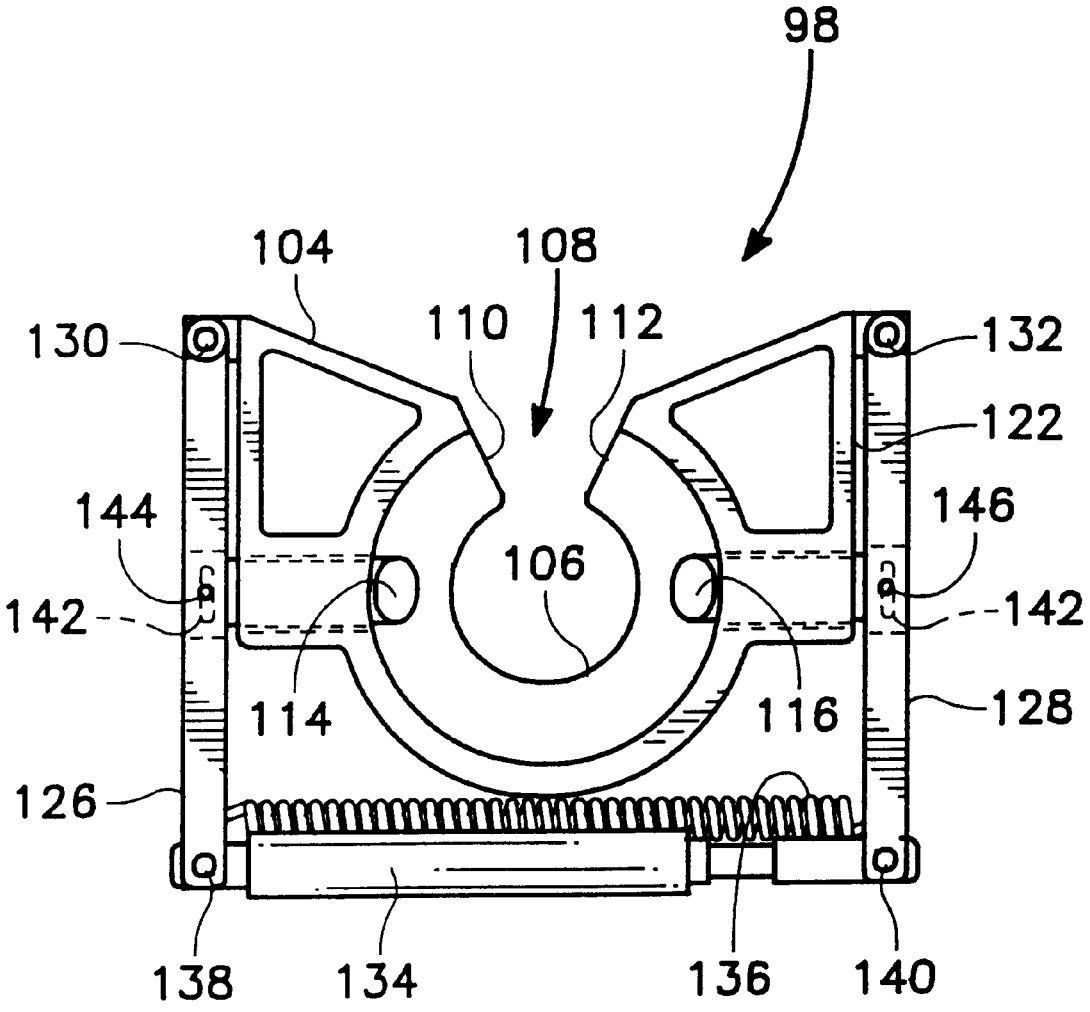
FIG. 6 is a bottom view taken along line 6—6 of FIG. 4 illustrating the capture and alignment mechanism of the handling system of FIG. 1 in a closed position.

Referring now to FIGS. 1, 5, 6 and 7, FIG. 5 depicts capture and alignment mechanism 98 of handling system 20 in an open position, while FIG. 6 depicts capture and alignment mechanism 98 of handling system 20 in a closed position. Capture and alignment mechanism 98 includes a capture body or housing 104 which has a conical shaped inner surface 106, an interior 107 formed within conical shaped inner surface 106 and an opening 108 which is formed between a pair of angled surfaces 110 and 112 located within capture body 104. Surfaces 110 and 112 of capture body 104 are outwardly angled from conical shaped inner surface 106 at angle of approximately 23°, allowing an entrance and exit path for cable 28.

Capture body 104 also includes a pair of capture pins 114 and 116 which are slidably mounted within a pair of cylindrical shaped openings 118 and 120. Cylindrical shaped openings 118 and 120 are aligned, positioned 180 degrees apart and are located within the bottom portion of capture body 104 (as shown in FIG. 7) extending from inner surface 106 of capture body 104 to outer surface 122 of capture body 104. Non-metallic high pressure bearings 124 allow for substantially frictionless movement of capture pins 114 and 116 within cylindrical shaped openings 118 and 120.

Positioned on opposite sides of capture body 104 are a pair of pivoting arms 126 and 128. One end of arm 126 pivots about a pivot arm pin 130 affixed to one side of capture body 104. In a like manner, one end of arm 128 also pivots about a pivot arm pin 132 affixed to the opposite side of capture body 104.

Connected between pivot arms 126 and 128 at their opposite ends is a pneumatic cylinder 134 and an extension spring 136. A pair of pivot pins 138 and 140 allow arms 126 and 128 to pivot about pneumatic cylinder 134.

Each capture pin 114 and 116 has a slot 142 positioned within its head. Slot 142 of capture pin 114 slidably engages a pivot pin 144 attached to arm 126, while slot 142 of capture pin 116 slidably engages a pivot pin 146 attached to arm 128 allowing capture pins 114 and 116 to move freely within cylindrical shaped openings 118 and 120.

Capture pins 114 and 116 are actuated to the open position (FIG. 5) by pneumatic cylinder 134 when pressurized air is supplied to pneumatic cylinder 134. When pressurized air to pneumatic cylinder 134 is turned off, capture pins 114 and 116 return to the close position (FIG. 6) and are held closed by extension spring 136.

Capture body 104 also has a bumper 148 mounted on its side adjacent sheave 80 to cushion the impact of capture and alignment mechanism 98 bumping into sheave 80.

Figure 8:
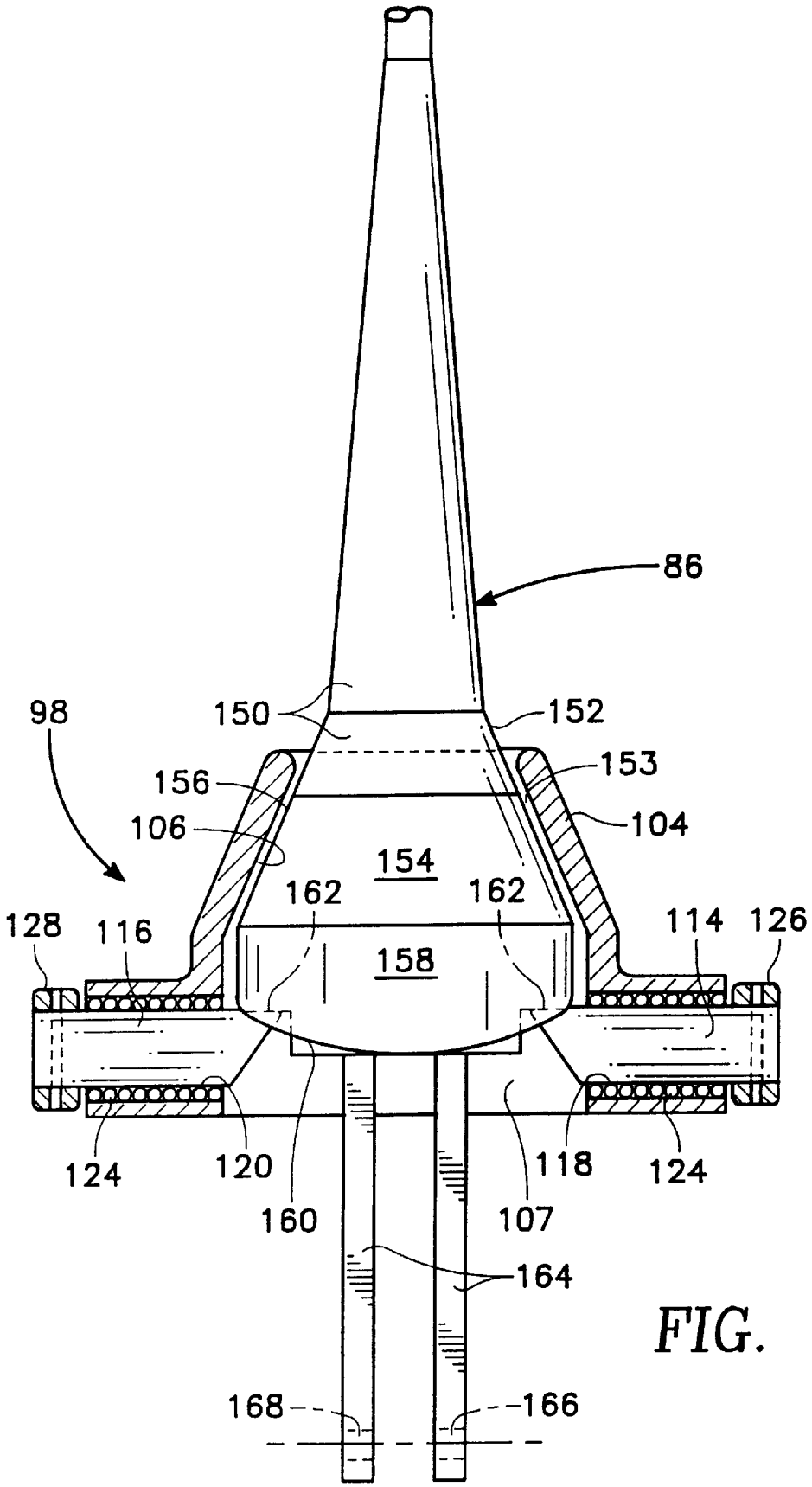
FIG. 8 is a front view in section illustrating the cable termination assembly when the capture and alignment mechanism of the handling system of FIG. 1 locks the cable termination assembly to the sheave assembly of the handling system of FIG. 1.
Figure 9:
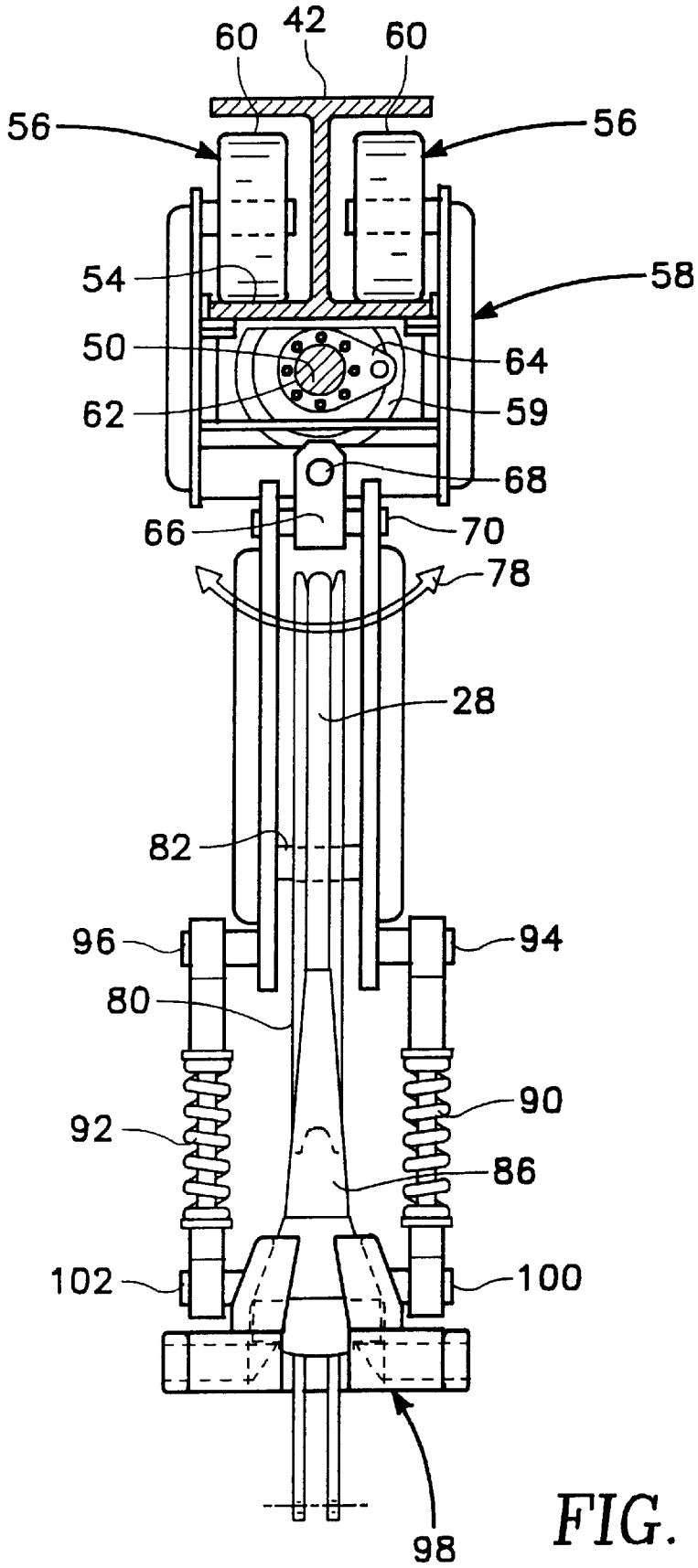
FIG. 9 is a front view illustrating the carriage, sheave assembly, the capture and alignment mechanism and cable termination assembly of the handling system of FIG. 1.

Referring to FIGS. 7 and 8, cable termination assembly 86 has a strain relief section 150 fabricated from a rubber like material, and a termination cone 154 which is below strain relief 150.

Termination cone 154 has a conical shaped mating surface 156 which aligns with the conical shaped inner surface 106 of capture and alignment mechanism 98 when the capture pins 114 and 116 of capture and alignment mechanism 98 engage and lock the cable termination assembly 86 in the manner illustrated in FIG. 8. Similarly the lower portion 152 of strain relief 150 has a conical shaped mating surface 153 which aligns and mates with the conical shaped inner surface 106 of capture and alignment mechanism 98 as shown in FIG. 8.

The bottom portion of cable termination assembly 86 comprises a termination wave section 158 which has a wave-like bottom surface 160 defined by the following cosine function:

$$X=0.625 \text{ COSINE } (2\times\text{ANGLE}) \quad (1)$$

where X is the depth of the surface 160 around its circumference and the ANGLE has a range of from 0° to 360°.

It should be noted that there is a gap 153 (FIG. 8) between surface 156 of termination cone 154 and surface 106 of capture and alignment mechanism 98 when the wave-like bottom surface 160 of termination wave section 158 rests on capture pins 114 and 116 in the manner depicted in FIG. 8.

When the cable termination assembly 86 is in the locked position illustrated in FIG. 8, capture pins 114 and 116 are engaging the low points/valleys 162 of wave-like bottom surface 160.

Attached to termination wave section 158 is a clevis 164. Clevis 164 has a pair of aligned openings for receiving a pin, bolt or the like for removably coupling body 22 (FIG. 1) to cable termination assembly 86.

Referring now to FIGS. 1, 5, 6, 7 and 8, in operation, as body 22 is hoisted up into the capture and alignment mechanism 98, the cable termination assembly 86 and capture body 104 align themselves. At this point, either the capture pins 114 and 116 are actuated such that pins 114 and 116 are retracted from the path of termination cone 154 or termination cone 154 spreads capture pins 114 and 116 apart. The capture pins 114 and 116 are actuated by the pneumatic cylinder 134 to the open position (FIG. 5). Capture pins 114 and 116 are held in the open position with air pressure. With the air pressure off, capture pins 114 and 116 return to the closed position (FIG. 6) and are held closed by extension spring 136.

After the capture body 104 and the termination cone 154 are mated as shown in FIG. 8 and capture pins 114 and 116 close, the weight of body 22 is lowered onto the wave-like bottom surface 160 of termination wave section 158. Capture and alignment mechanism 98 suspends the weight by the capture pins 114 and 116. When the weight of body 22 is lowered onto capture pins 114 and 116, and body 22 is rotated up to 90 degrees from its straight ahead (as shown in FIG. 1 which is the direction of travel of ocean going vessel 20), the capture pins 114 and 116 will first contact a high point on wave-like bottom surface 160 of termination wave section 158. As the weight of body 22 is taken up by the capture pins 114 and 116, capture pins 114 and 116 will tend to settle in the low points/valleys 162 of bottom surface 160.

It should be noted that when the system is in this equilibrium position, there is a small space between termination cone 154 and the conical shaped inner surface 106 of capture body 104 to permit the necessary vertical displacement which occurs as the body 22 rotates. The wave-like bottom surface 160 of termination wave section 158 is used to keep body 22 always facing forward as shown in FIG. 1. The wave-like bottom surface 160 of termination wave section 158 also has the flexibility to allow body 22 to move free without stressing capture and alignment mechanism 98 when forces acting on body 22 tries to rotate it or lift it. These forces are generally attributed to the ship's motion while body 22 is at water level. Resistance to rotation of body 22 is limited by the body's weight as it hangs from capture and alignment mechanism 98.

From the foregoing, it may readily be seen that the present invention comprises a new, unique and exceedingly useful capture and alignment mechanism for use on board an ocean going vessel which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. A capture and alignment mechanism for use with a shipboard handling system located on board an ocean going vessel, said shipboard handling system having a cable, said capture and alignment mechanism comprising:

a capture body having a conical shaped inner surface, an interior formed within said conical shaped inner surface and an opening formed between a pair of angled surfaces within said capture body, said pair of angled surfaces being outwardly angled from said conical shaped inner surface at a predetermined angle to provide an entrance path and an exit path for said cable;

first and second cylindrical shaped openings positioned one hundred eighty degrees apart within a bottom portion of said capture body, said first and second cylindrical shaped openings extending from the inner surface of said capture body to an outer surface of said capture body;

a first capture pin slidably mounted within said first cylindrical shaped opening, said first capture pin extending into the interior of said capture body;

a second capture pin slidably mounted within said second cylindrical shaped opening, said second capture pin extending into the interior of said capture body;

retracting means for retracting said first capture pin and said second capture pin from the interior of said capture body to an open position, said retracting means including means for returning said first capture pin and said second capture pin into the interior of said capture body to a closed position;

a cable termination assembly secured to an end of said cable extending from said shipboard handling system, said cable termination assembly including a termination cone having a conical shaped outer surface adapted to mate with the conical shaped inner surface of said capture body and a termination wave section positioned below said termination cone, the termination wave section of said cable termination assembly having a wave-shaped bottom surface; and a clevis attached to the termination wave section of said cable termination assembly, said clevis being adapted to couple a deployable body to said cable;

said capture pins engaging the wave-shaped bottom surface of the termination wave section of said cable termination assembly when said termination cone mates with the interior of said capture body and said capture pins are in the closed position to lock said deployable body to said shipboard handling system.

2. The capture and alignment mechanism of claim 1 wherein the wave-shaped bottom surface of said termination wave section approximates a cosine function expressed by the equation:

$$X=0.625 \text{ COSINE } (2\times\text{ANGLE})$$

where X is the depth of the wave-shaped bottom surface around the circumference of the wave-shaped bottom surface and ANGLE has a range of from 0° to 360°.

3. The capture and alignment mechanism of claim 1 wherein the wave-shaped bottom surface of said termination wave section allows for rotational movement of said deployable body from a first position which aligns with a direction of travel of said ocean going vessel to a second position which is in a range of from about one degree to about ninety degrees from the direction of travel of said ocean going vessel.

4. The capture and alignment mechanism of claim 1 wherein said first and second cylindrical shaped openings have a plurality of non-metallic high pressure bearings, said plurality of non-metallic high pressure bearings within said first cylindrical shaped opening allowing for substantially frictionless movement of said first capture pin within said first cylindrical shaped opening and said plurality of non-metallic high pressure bearings within said second cylindrical shaped opening allowing for substantially frictionless movement of said second capture pin within said second cylindrical shaped opening.

5. The capture and alignment mechanism of claim 1 wherein a gap is provided between the conical shaped outer surface of said termination cone and the conical shaped inner surface of said capture body when the wave-shaped bottom surface of said termination wave section is resting on said first capture pin and said second capture pin.

6. The capture and alignment mechanism of claim 1 wherein said retracting means comprises:

first and second pivoting arms, said first pivoting arm having a first end pivotally connected to one side of said capture body and said second pivoting arm having a first end pivotally connected to an opposite side of said capture body;

a pneumatic cylinder having a first end pivotally connected to a second end of said first pivoting arm and a second end pivotally connected to a second end of said second pivoting arm;

a first pivot pin attached to said first pivoting arm, said first pivot pin slidably engaging a slot within a head end of said first capture pin; and a second pivot pin attached to said second pivoting arm, said second pivot pin slidably engaging a slot within a head of said second capture pin.

7. The capture and alignment mechanism of claim 1 wherein said means for returning said first capture pin and said second capture pin into the interior of said capture body to said closed position comprises a spring.

8. A capture and alignment mechanism for use with a shipboard handling system located on board an ocean going vessel, said shipboard handling system having a cable, said capture and alignment mechanism comprising:

a capture body having a conical shaped inner surface, an interior formed within said conical shaped inner surface and an opening formed between a pair of angled surfaces within said capture body, said pair of angled surfaces being outwardly angled from said conical shaped inner surface at a predetermined angle to provide an entrance path and an exit path for said cable;

first and second cylindrical shaped openings positioned one hundred eighty degrees apart within a bottom portion of said capture body, said first and second cylindrical shaped openings extending from the inner surface of said capture body to an outer surface of said capture body;

a first capture pin slidably mounted within said first cylindrical shaped opening, said first capture pin extending into the interior of said capture body;

a second capture pin slidably mounted within said second cylindrical shaped opening, said second capture pin extending into the interior of said capture body;

first and second pivoting arms, said first pivoting arm having a first end pivotally connected to one side of said capture body and said second pivoting arm having a first end pivotally connected to an opposite side of said capture body;

a pneumatic cylinder having a first end pivotally connected to a second end of said first pivoting arm and a second end pivotally connected to a second end of said second pivoting arm;

a first pivot pin attached to said first pivoting arm, said first pivot pin slidably engaging a slot within a head end of said first capture pin; and a second pivot pin attached to said second pivoting arm, said second pivot pin slidably engaging a slot within a head of said second capture pin said pneumatic cylinder when activated rotating said first pivoting arm and second pivoting arm outward from said capture body retracting said first capture pin and said second capture pin from the interior of said capture body to an open position;

a spring having a first end connected to the second end of said first pivoting arm and a second end connected to the second end of said second pivoting arm;

said spring rotating said first pivoting arm and second pivoting arm inward to said capture body when said pneumatic cylinder is de-activated returning said first capture pin and said second capture pin into the interior of said capture body to a closed position;

a cable termination assembly secured to an end of said cable extending from said shipboard handling system, said cable termination assembly including a termination cone having a conical shaped outer surface adapted to mate with the conical shaped inner surface of said capture body and a termination wave section positioned below said termination cone, the termination wave section of said cable termination assembly having a wave-shaped bottom surface; and a clevis attached to the termination wave section of said cable termination assembly, said clevis being adapted to couple a deployable body to said cable;

said capture pins engaging the wave-shaped bottom surface of the termination wave section of said cable termination assembly when said termination cone mates with the interior of said capture body and said capture pins are in the closed position to lock said deployable body to said shipboard handling system.

9. The capture and alignment mechanism of claim 8 wherein the wave-shaped bottom surface of said termination wave section approximates a cosine function expressed by the equation:

$$X=0.625 \text{ COSINE } (2\times\text{ANGLE})$$

where X is the depth of the wave-shaped bottom surface around the circumference of the wave-shaped bottom surface and ANGLE has a range of from 0° to 360°.

10. The capture and alignment mechanism of claim 8 wherein the wave-shaped bottom surface of said termination wave section allows for rotational movement of said deployable body from a first position which aligns with a direction of travel of said ocean going vessel to a second position which is in a range of from about one degree to about ninety degrees from the direction of travel of said ocean going vessel.

11. The capture and alignment mechanism of claim 8 wherein said first and second cylindrical shaped openings have a plurality of non-metallic high pressure bearings, said plurality of non-metallic high pressure bearings within said first cylindrical shaped opening allowing for substantially frictionless movement of said first capture pin within said first cylindrical shaped opening and said plurality of non-metallic high pressure bearings within said second cylindrical shaped opening allowing for substantially frictionless movement of said second capture pin within said second cylindrical shaped opening.

12. The capture and alignment mechanism of claim 8 wherein a gap is provided between the conical shaped outer surface of said termination cone and the conical shaped inner surface of said capture body when the wave-shaped bottom surface of said termination wave section is resting on said first capture pin and said second capture pin.

* * * * *